United States Patent [19]

Nicol et al.

[11] Patent Number: 4,561,160

[45] Date of Patent: Dec. 31, 1985

[54] METHOD OF ALTERING A CONVENTIONAL TUB FOR THE HANDICAPPED

[76] Inventors: Paul G. Nicol, 285 Bradford Ter., Manomet, Mass. 02345; William W. Nicol, 3D Markham Cir., Ayer, Mass. 01432

[21] Appl. No.: 660,493

[22] Filed: Oct. 12, 1984

[51] Int. Cl.[4] ..... B23P 7/00

[52] U.S. Cl. ..... 29/401.1; 4/555

[58] Field of Search ..... 29/401.1; 4/556, 555, 4/584

[56] References Cited

U.S. PATENT DOCUMENTS 3,559,216 2/1971 Kyte ..... 4/555

FOREIGN PATENT DOCUMENTS 88728 9/1983 European Pat. Off. .

2484249 12/1981 France ..... 4/555

2522488 9/1983 France ..... 4/555

1226206 3/1971 United Kingdom ..... 4/555

*Primary Examiner*—Howard N. Goldberg

*Assistant Examiner*—Vernon K. Rising

*Attorney, Agent, or Firm*—Robert T. Gammons

[57] ABSTRACT

The method of retrofitting a conventional tub of the kind having spaced inner and outer walls for the handicapped comprising removing a section of the wall of the tub from the rim down to a level just above the bottom to provide an opening at the side of the tub and refinishing the sides and bottom of the opening to match the contour and finish of the tub.

4 Claims, 9 Drawing Figures

METHOD OF ALTERING A CONVENTIONAL TUB FOR THE HANDICAPPED

BACKGROUND OF THE INVENTION

Tubs for bathing purposes have been structured with an opening in the side to enable persons to gain access to the tub without having to step over the rim, which can be exceptionally dangerous for persons with handicaps of one kind or another due to the fact that the surface of the tub is very slippery when wet with soapy water. Tubs provided with side openings therein of various kinds are shown in the following U.S. Pat. Nos. p1
2,204,929
3,380,078
3,559,216
3,864,762
4,399,569;
and British Pat. No. 1226206
and French Pat. No. 2522488.

In each of the aforesaid patents, a closure is provided for the side opening and the structure shown therein, while functional for the purpose intended, requires that the tub be specially constructed for this purpose and substituted for the conventional tub, which can be expensive and out of the question for elderly persons with limited incomes.

It is the purpose of this invention to make it possible for handicapped persons who have become incapacitated to avoid the cost of replacing a conventional tub with a specially constructed tub such as shown in any of the aforesaid patents by retrofitting the tub already in use and, by such retrofitting, provide a tub which is both safe to use and attractive in appearance.

SUMMARY OF THE INVENTION

As herein illustrated, the invention comprises a method of altering or retrofitting a conventional tub by removing a generally rectangular section of one wall of the tub extending from the rim downwardly to a level above the bottom which is more than half the height of the wall to thus define a permanent opening in the wall, the bottom of which is above the bottom of the tub, reducing the depth of the removed section to less than half its original depth, replacing the reduced section in the opening at the bottom, filling the sides of the opening between the inner and outer side walls of the wall from the rim down to the replaced section and finishing the sides and bottom of the opening with a composition comparable to the finish of the tub. Removing the generally rectangular section is achieved by making spaced, parallel cuts through the inner and outer walls of the side of the tub from the rim down to a level below half the height of the side, but above the bottom, and then cutting longitudinally from the lower end of one cut to the other. The removed section is then reduced in depth by cutting off the lower edges. The sides of the opening between the inner and outer walls are filled by inserting studs between the inner and outer walls and securing them in place, whereupon a resin-based putty is applied to the exposed surfaces. The surface of the resin when set is coated with a gel coat and thereafter wet-sanded, polished and waxed.

The invention will now be described in greater detail with reference to the accompanying drawings, wherein.

Figure 1:
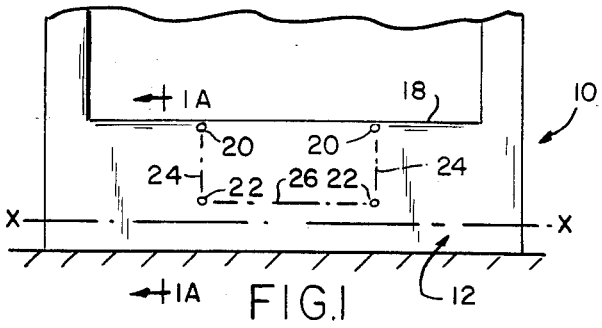
FIG. 1 is a side elevation of a conventional tub showing the initial operation for removing a section from a side thereof.
Figure 2:
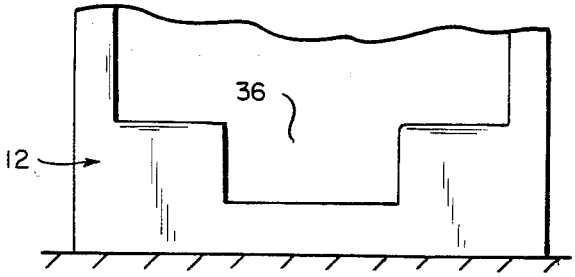
FIG. 2 is a side elevation with a section removed for the purpose of providing a side opening.
Figure 1A:
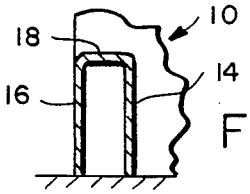
FIG. 1A is a section taken on the line 1*a*—1*a* of FIG. 1.

Referring to the drawings, FIG. 1, there is shown in elevation a conventional tub 10, at one end of which there is a wall-supported shower, not shown. The tub is of the kind having a wall 12 along at least one side over which it is necessary to step to gain access to the tub comprising inner and outer wall sections 14 and 16, as shown in section in FIG. 1A. If the tub is of the type that sets on the floor, as distinguished from being recessed into the floor, the height of the side wall 12 presents a problem to handicapped persons when trying to step into the tub or step out of the tub due to the fact that the rim 18 of the tub is generally 12 to 16 inches above the floor level. A handicapped person having to raise one foot from the floor and put it into the tub or having to raise one foot from within the tub and put it out on the floor can easily lose his balance with disastrous consequences.

While tubs have been constructed in the past, as shown by the patents referred to above, to facilitate handicapped persons getting into and out of the tub, generally they have been unsatisfactory from the standpoint of appearance, maintenance, and particularly cost. As stated above, the purpose of this invention is to retrofit an already installed tub and this is achieved in the following manner, having reference to FIG. 1.

Holes 20—20 are drilled through the walls 14 and 16 at the top, holes 22—22 are drilled through the walls of the tub vertically below the holes 20—20, the holes 20—20 being positioned to define a substantially rectangular array, whereupon the walls 14,16 are sawed along the vertical lines 24—24 from the holes 20—20 to the holes 22—22 and along horizontal lines 26—26 between the holes 22—22. The cuts 24—24, 26—26 separate a section 28 from the wall, FIG. 3, which comprises the rim 18 and portions of the side walls 14 and 16. Desirably, the depth of the cuts 24—24 is greater than half the depth of the wall of the tub from the rim 18 to the bottom line, but is above the bottom of the tub represented by the dotted line X—X.

Figure 3:
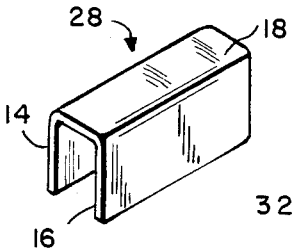
FIG. 3 is a perspective of the section removed.
Figure 4:
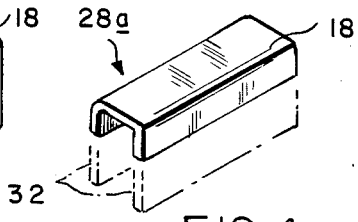
FIG. 4 is a perspective of the aborted section.
Figure 6:
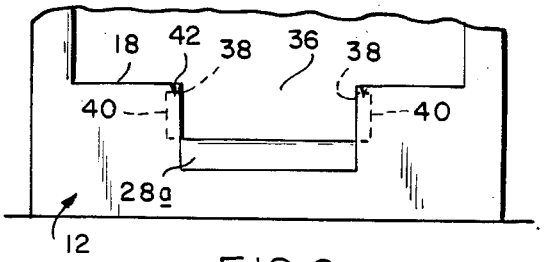
FIG. 6 is an elevation of the tub with the aborted section replaced at the bottom of the opening and studs filling the space between the inner and outer wall sections.

The removed section 28, illustrated in FIG. 3, is now reduced in height by cutting off lower portions or strips 32—32 therefrom so as to shorten it from top to bottom by at least half of its depth, FIG. 4. The aborted section 28*a*, FIG 4, is now replaced in the opening 36 to provide at the bottom of the opening 36 a smooth rim corresponding in configuration to the rim at the top of the tub.

Figure 5:
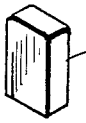
FIG. 5 is a perspective of a stud for filling the space between the inner and outer walls at the cutout.
Figure 7:
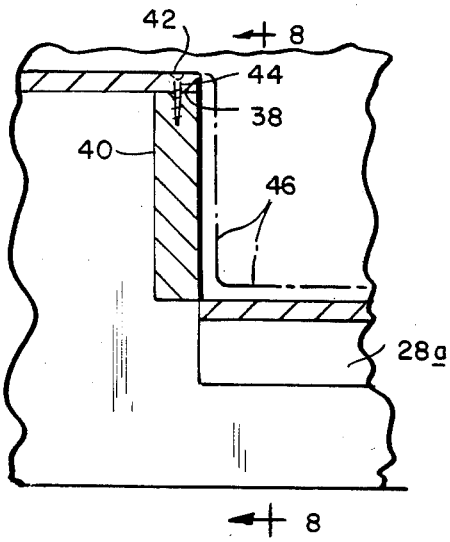
FIG. 7 is an enlarged section showing studs inserted in the opening between the inner and outer walls of the opening at opposite sides of the opening.
Figure 8:
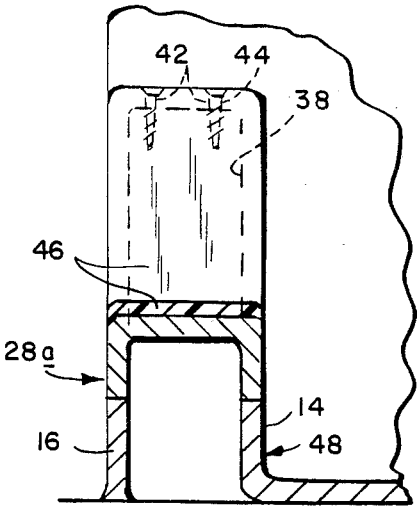
FIG. 8 is an enlarged section taken on the line 8—8 of FIG. 7 at one side of the opening showing the finish layers.

Removing the section 28 leaves openings 38—38 at opposite sides of the opening 36, FIGS. 7 and 8, between the inner and outer walls 14 and 16 and these openings are closed by inserting studs 40—40, FIG 5, therein, dimensioned to extend from the rim of the tub down to the top of the replaced section 28*a*. The studs 40—40 are secured in place by screws 42 inserted through openings 44 drilled through the rim of the tub.

The entire opening 36 defined by the section 28*a* at the bottom and the studs 40—40 at the sides is now refinished by applying a coating of polyester resin-based putty 46 to the bottom and sides of the opening and sanding and shaping the surface to a suitable configuration. The area is then sprayed with a gel coat, wet-sanded, polished and waxed.

The structure thus described can be positioned midway between the ends of the tub to provide a center opening, or at one end or the other to provide a right or a left opening. Desirably, the bottom of the opening 36 is above the bottom of the tub to leave a small lip or curb 48, 2 to 4 inches from the bottom, as shown in FIG. 8, to allow for some water at the bottom of the tub.

The method described above affords a very inexpensive way of retrofitting an already installed tub for the convenience of a handicapped person, invalid or older person when it becomes difficult for the person to gain access to the tub without danger, enabling the person to use the shower without assistance, and provides this facility without the exhorbitant expense of replacing a conventional tub with a specially constructed tub.

It should be understood that the present disclosure is for the purpose of illustration only and includes all modifications or improvements which fall within the scope of the appended claims.

What is claimed is:

1. The method of altering a conventional tub for the handicapped comprising removing a generally rectangular section of a wall of a tub having spaced-apart inner and outer side walls extending from the rim down to a level above the bottom which is more than half the height of the wall, thus defining an opening in the wall, the bottom of which is above the bottom of the tub, reducing the depth of the removed section to less than half its original depth, replacing the reduced section in the opening at the bottom, filling the sides of the openings betwen the inner and outer side walls of the wall from the rim down to the replaced section and finishing the sides and bottom of the opening with a compound comparable with the finish of the tub.

2. The method of altering a conventional tub for the handicapped comprising at longitudinally-spaced points cutting the inner and outer side wall sections of the side walls of the tub from the rim down to a level below half the height of the side wall, but above the bottom, then cutting longitudinally from the lower end of one cut to the other, removing the cut section of the wall to thus provide an opening in the side of the tub, cutting off the lower portions of the inner and outer wall sections of the removed section to provide a section of lesser depth that the depth of the opening, replacing the aborted section at the bottom of the opening, filling the spaces between the inner and outer wall sections at the opposite sides of the opening with studs and finishing the areas defined by the sides and bottom of the opening with a compound comparable to the finish of the tub.

3. A method according to claim 2 comprising securing the studs in the openings between the inner and outer wall sections of the side of the tub with screws.

4. A method of retrofitting a conventional tub for the handicapped comprising removing a generally rectangular section of a wall of a tub having spaced-apart inner and outer side wall sections extending from the rim downwardly to a level above the bottom which is more than half the height of the wall to thus define an opening in the bottom, the bottom of which is above the bottom of the tub, reducing the depth of the removed section to less than half the original depth, replacing the reduced section in the opening at the bottom, filling the sides of the opening between the inner and outer side wall sections from the rim down to the replaced section, applying a polyester resin-based putty to the sides and bottom of the opening to provide a surface layer contour corresponding to that of the tub, applying a gel coating to the polyester resin surface layer and wet-sanding, polishing and waxing the latter.

* * * * *